US006830132B1

(12) United States Patent
Kang et al.

(10) Patent No.: US 6,830,132 B1
(45) Date of Patent: Dec. 14, 2004

(54) BRAKE DEVICE FOR ELEVATOR

(75) Inventors: Shin-joon Kang, Inchon (KR); Chae-Min Hong, Kyunggido (KR); Jong-Myeon Kim, Kyunggido (KR); Jong-Soon Kim, Kyunggido (KR); Jong-Soo Kim, Kyunggido (KR)

(73) Assignees: Korea Occupational Safety & Health Agency, Inchon (KR); Leesung Construction, Icheon-shi (KR)

( * ) Notice: Subject to any disclaimer, the term of this patent is extended or adjusted under 35 U.S.C. 154(b) by 0 days.

(21) Appl. No.: 10/203,317

(22) PCT Filed: Apr. 18, 2000

(86) PCT No.: PCT/KR00/01538

§ 371 (c)(1),
(2), (4) Date: Aug. 9, 2002

(87) PCT Pub. No.: WO01/79103

PCT Pub. Date: Oct. 25, 2001

(51) Int. Cl.[7] ..... B66B 5/04; B66B 9/02
(52) U.S. Cl. ..... 187/373; 187/271
(58) Field of Search ..... 187/270, 271, 187/236, 305, 375, 373

(56) References Cited

U.S. PATENT DOCUMENTS 1,634,865 A * 7/1927 Scollard ..... 187/270
3,415,343 A * 12/1968 Svensson ..... 187/352
3,866,717 A * 2/1975 Johansson ..... 187/352
3,924,710 A * 12/1975 Shohet ..... 187/270
3,967,703 A * 7/1976 Martin ..... 187/373
4,269,285 A * 5/1981 Ohkoshi et al. ..... 187/270
4,516,663 A * 5/1985 D'Alessio et al. ..... 187/270
4,856,623 A 8/1989 Romig, Jr.
5,353,895 A 10/1994 Camack et al.
5,366,045 A 11/1994 Liston
6,345,547 B1 * 2/2002 Stoelinga et al. ..... 187/270

FOREIGN PATENT DOCUMENTS

JP 10 157939 6/1998

* cited by examiner

*Primary Examiner*—Eileen D. Lillis
*Assistant Examiner*—Thuy V. Tran
(74) *Attorney, Agent, or Firm*—Burns, Doane, Swecker & Mathis, L.L.P.

(57) ABSTRACT

A brake device for elevator, including a hollow box-shaped elevator car (1) for holding the passenger or luggage; block (5) having a pair of guide rails (6) for guiding upwards and downwards the elevator car (1); a plurality of racks (4) disposed at the block (5) along the lifting direction in vertical; at least one motor (2) tooth-engaged with at least one pinion (2*a*) at the racks (4), for lifting upwards and downwards the elevator car (1), clutch (12) for controlling power transmission to connect a driving shaft (19) to a driven shaft (20) when the pinions (11) engaged with the racks (4) are rotated at high speed due to elevator crash; hydraulic pump (15) for generating hydraulic pressure from power transmission through a plurality of transmission gears (13) when the clutch (12) delivers rotation; and a plurality of hydraulic cylinders (17) for braking the elevator by brake pad (18) in tight coupled with the guide rails (6) by hydraulic power from the hydraulic pump (15). When fall of the elevator is detected, hydraulic pressure actuates the brake pad to brake the elevator and the brake device utilizes friction with less impact, thereby protecting the passengers or luggage from sudden impact.

3 Claims, 7 Drawing Sheets

BRAKE DEVICE FOR ELEVATOR

TECHNICAL FIELD

The present invention relates to a brake device for elevator, and more particularly, a brake device for elevator by use of hydraulic pressure generated by fall in construction work or building to enable the brake pad to brake the elevator, thereby preventing free fall or crash accident of the elevator.

BACKGROUND ART

Conventional elevator used in construction work is constructed such that the elevator is lifted upwards and downwards along the multi-stage assembled block as shown in FIGS. 1 to 3.

The elevator car 1 has a pair of guide rail rollers 1*a* for moving along a guide rail 6 of the block 5. Two guide rail rollers 1*a* are disposed at front and rear with respect to the guide rail 6, to guide the elevator upwards and downwards. A hook 1*b* is disposed to guide the guide rail 6, for preventing deviation of the elevator car 1.

A plurality of motors 2 and pinions 2*a* are employed in the elevator car 1, for actuating the elevator to be lifted in any desired direction. A plurality of racks 4 is disposed at the block 5 in the vertical direction. Driving of the motor 2 allows the pinions 2*a* to be rotated along the racks 4, so that the elevator car 1 is lifted upwards and downwards.

Especially the elevator car 1 for use in construction work is required to attention safety since the elevator car is exposed at all times, and nevertheless the brake device is most important.

Conventional brake device of the elevator shows use of a governor 3. The governor-braking device utilizes centrifugal force, in which the pinion 3*a* of the governor 3 for brake device is engaged with the rack 4 at the block. To the pinion a centrifugal weight is connected.

In case of fall or crash of the elevator due to abnormality such as malfunction or etc., the pinion 3*a* of the governor 3 of the elevator is rotated at high speed by the rack 4, so that centrifugal weight being spread becomes held onto boss in the brake device to stop the pinion 3*a* and to brake the elevator car 1.

Because lifting operation of the elevator car 1 is dependent on pinion 2*a* and rack 4, the longer the elevator is used, the more fatigue the rack and pinion receive. The governor 3 intends to stop the elevator in crash but the rack weakened by fatigue practically receives a heavy impact. As a result, the gear teeth of the rack 4 or pinion 3*a* of the governor 3 become damaged, resulting in fall or crash accident of the elevator. In a normal working condition, the elevator moves smoothly and impact does not harm on the passenger or luggage. However, in case of crash of elevator, heavy impact is accompanied with stop of the elevator by the governor, resulting in severe damage on luggage or passengers.

The building elevator operated by rope also utilizes the brake device by governor.

This construction has a disadvantage of damage of passenger or luggage by heavy impact in stopping the elevator being fallen down.

The present invention is derived to solve the disadvantage of the conventional art and to generate hydraulic pressure after detecting free fall or crash of the elevator and actuate a brake pad by hydraulic pressure, so that impact by sudden brake is relieved to maintain a stable brake interval and prevent the brake device from being damaged by heavy impact caused by sudden brake.

The object of the present invention is accomplished by providing a hollow box-shaped elevator car 1 for holding the passenger or luggage; block 5 including a pair of guide rails 6 for guiding upwards and downwards the elevator car 1; a plurality of racks 4 disposed at the block 5 along the lifting direction in vertical; at least one motor 2 tooth-engaged with at least one pinion 2*a* at the racks 4, for lifting upwards and downwards the elevator car 1; a clutch 12 for controlling power transmission to connect a driving shaft 19 to a driven shaft 20 when the pinions 2*a* and 11 engaged with the racks 4 are rotated at high speed due to elevator drop; hydraulic pump 15 for generating hydraulic pressure from power transmission though a plurality of transmission gears 13 when the clutch 12 delivers rotation; and a plurality of hydraulic cylinders 17 for braking the elevator by brake pad 18 in tight coupled with the guide rails 6 by hydraulic power from the hydraulic pump 15.

In crash of the elevator, the clutch actuates to operate the brake pad by hydraulic power from the hydraulic pump, thereby receiving impact and protecting passengers or luggage in the elevator.

The elevator is stopped by friction brake with less impact onto the passenger or luggage, so that safety and reliability are improved.

BRIEF DESCRIPTION OF THE DRAWINGS

The present invention will be described in detail through use of the accompanying drawings in which.

BEST MODE FOR CARRYING OUT THE INVENTION

The presently preferred embodiments of the invention will be best understood by reference to the drawings.

Figure 1:
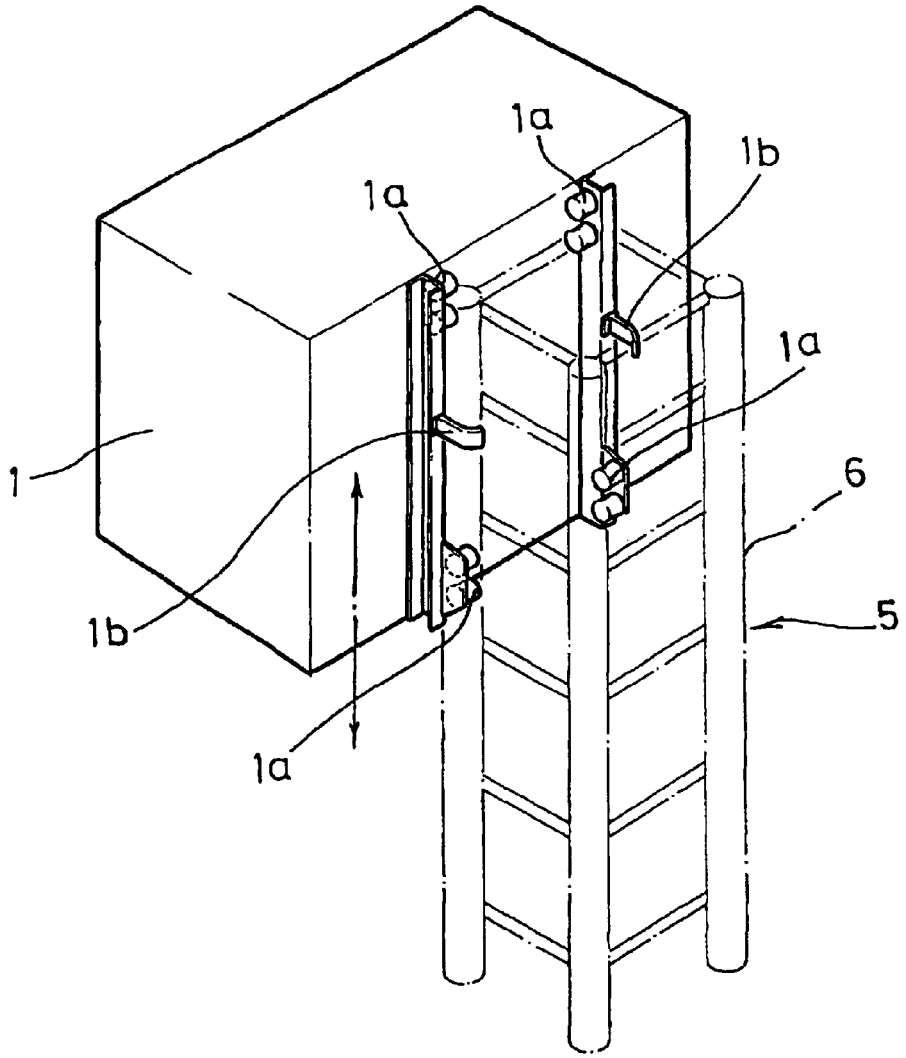
FIG. 1 is a perspective view of conventional elevator.
Figure 2:
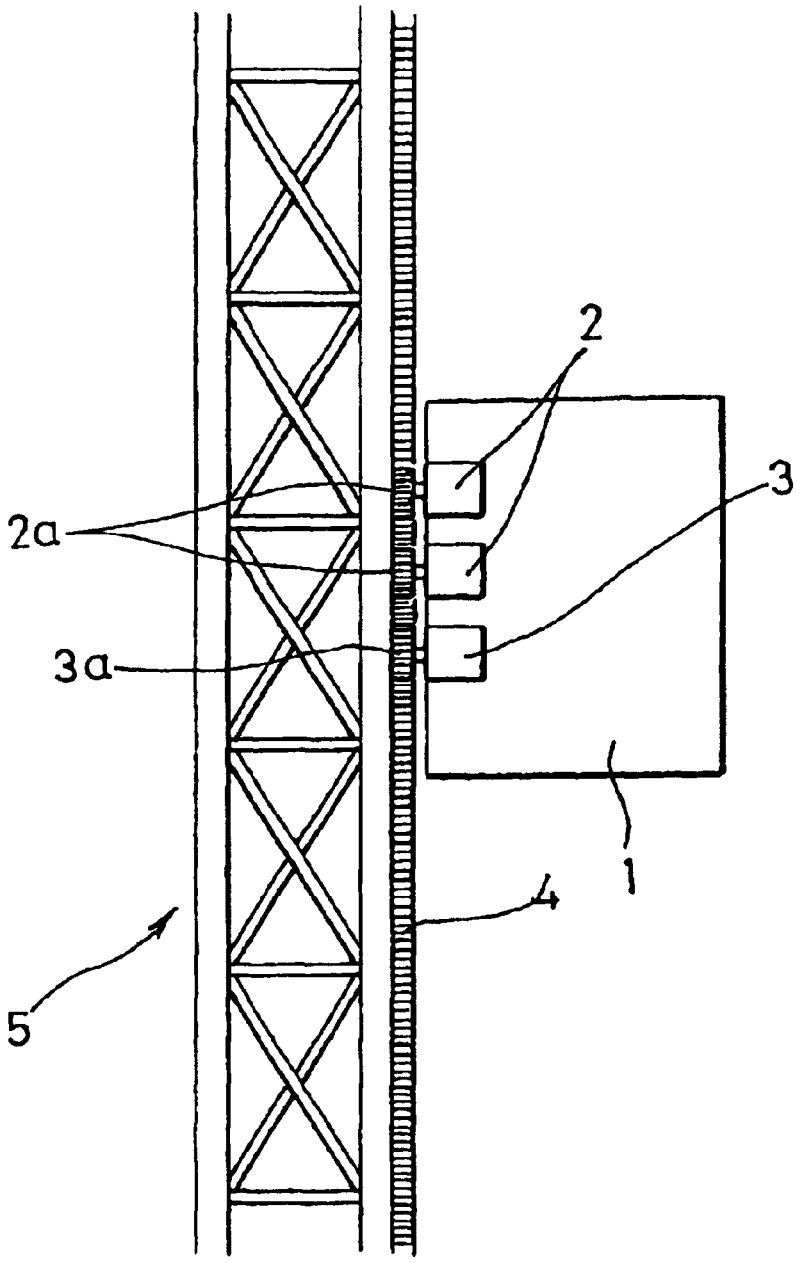
FIG. 2 is a side view of the elevator used in construction work.
Figure 3:
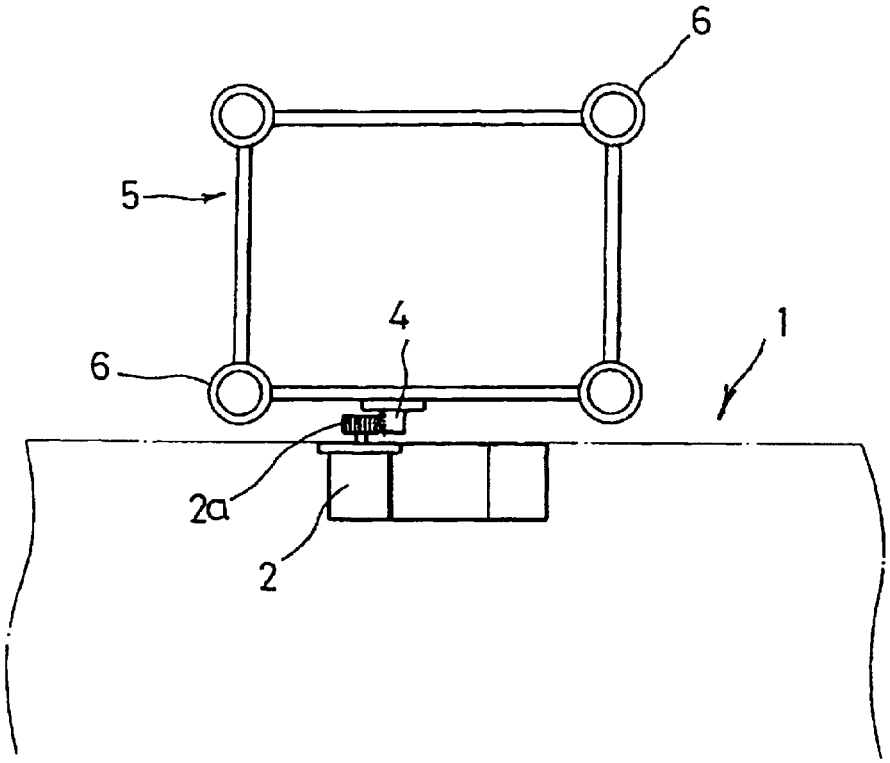
FIG. 3 is a plane view of the elevator used in construction work.
Figure 4:
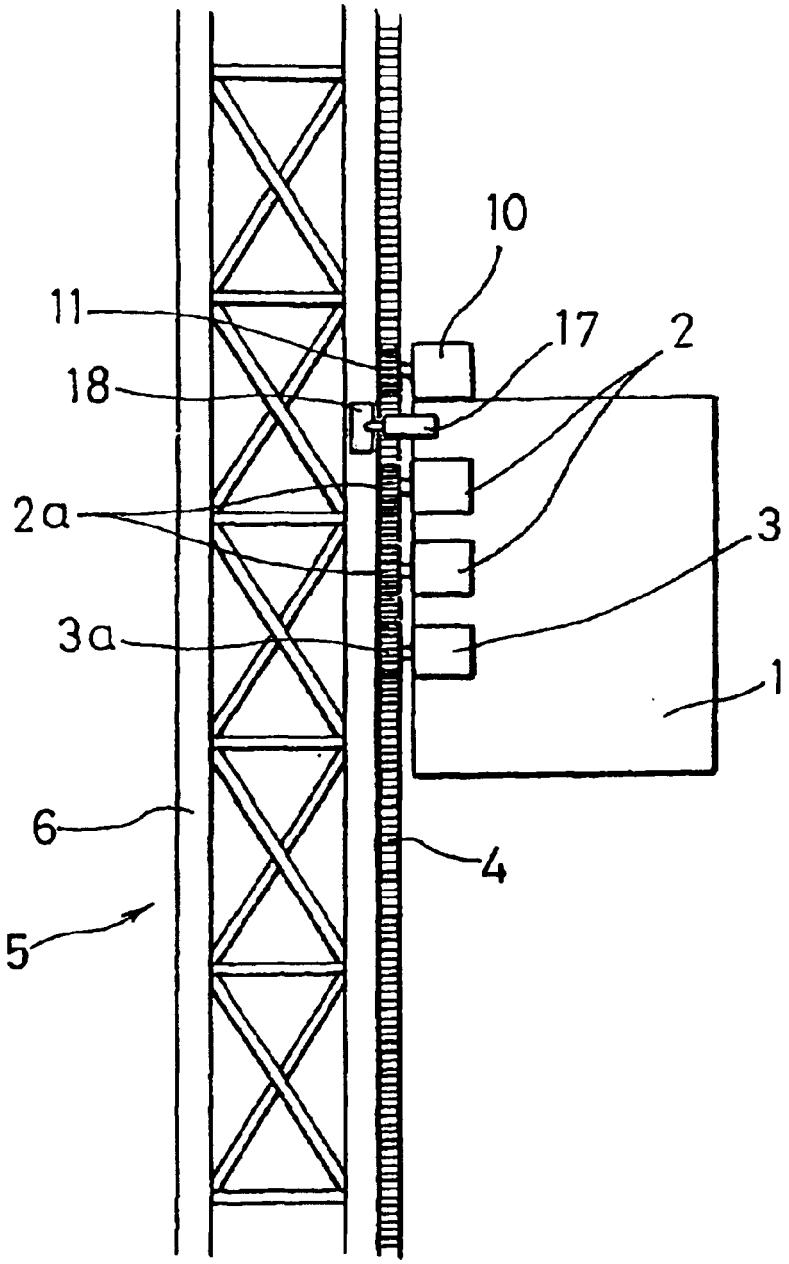
FIG. 4 is a side view of the elevator having a brake device according to the present invention for use in construction work.
Figure 5:
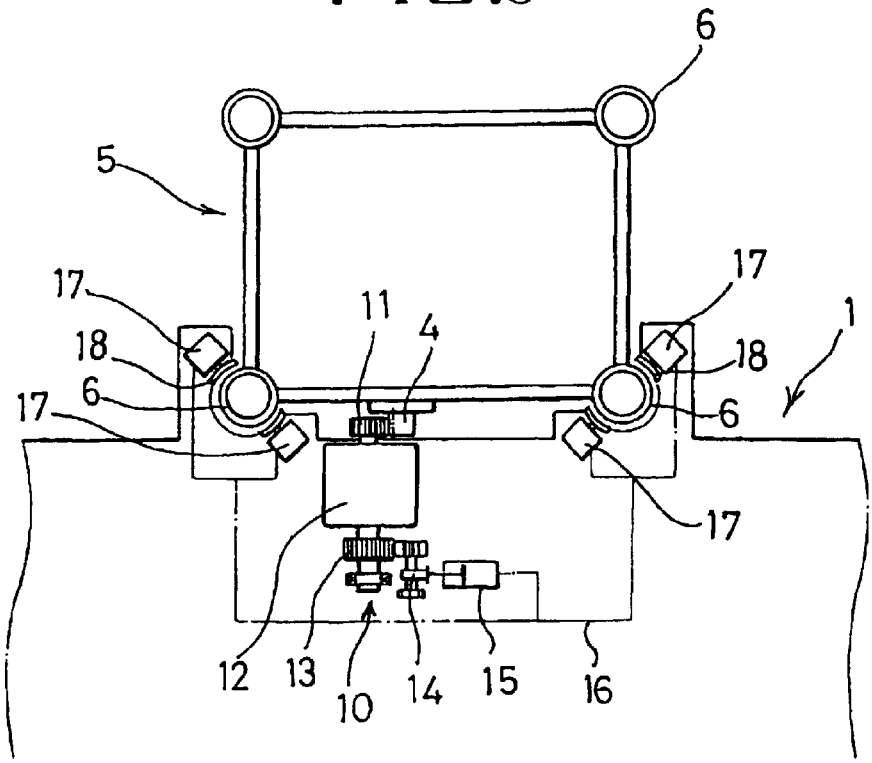
FIG. 5 is a plane view of the brake device according to the present invention.

FIG. 4 is a side view of the elevator having a brake device according to the present invention for use in construction work, and FIG. 5 is a plane view of the brake device according to the present invention.

The elevator car 1 is constituted to have a hollow box-shape to accommodate passengers or luggage. The elevator car 1 is lifted upwards or downwards along the block 5.

The block 5 assembled in stacked includes guide rails 6 in vertical. The guide rails 6 are crossed in zigzag, to form a guide rail for the elevator car 1.

A plurality of racks 4 is disposed at one side of the block 5 toward the elevator car 1. The elevator car 1 includes pinions 2*a* to rotate with the motor shaft of the motor 2.

The pinion 2*a* is tooth-engaged with the rack 4 at the guide rail 6. In driving the motor 2, the rack 4 allows the elevator car 1 to lift upwards and downwards along rotational direction of the pinion 2*a*.

The pinion 2*a* and motor 2 are constructed to be a couple for an elevator car 1.

A governor 3 can be also shown as the conventional one, for emergency. The governor 3 holds a weight when the weight is widened by centrifugal force, the governor 3 for brake device actuated.

The pinion 3*a* of governor 3 shows a toothed engagement with rack 4. A centrifugal weight is connected to the pinion 3*a*. When the elevator is being fallen, the pinion 3*a* in tooth-engagement with the rack 4 is rotated at high speed, and the centrifugal weight being spread becomes held into boss in the brake device to stop the pinion 3*a*, so as to brake the elevator car 1.

The elevator car 1 includes a hydraulic brake means 10.

The hydraulic brake means 10 comprises a clutch 12, a transmission gear 13, a hydraulic pump 15, hydraulic cylinders 17 and brake pads 18 actuated by friction.

The clutch 12 has a pinion 11 engaged with the rack 4.

The transmission gear 13 may include bevel gear, spur gear, helical gear or a combination thereof if transmission direction and frictional noise by tooth-engagement are considered.

A cam 14 connects the hydraulic pump 15 and the transmission gear 13 and rotation of the cam 14 generates hydraulic pressure from the hydraulic pump 15.

The hydraulic pressure is delivered to the hydraulic cylinder 17 through the hydraulic line 16. A piston in motion by the hydraulic cylinder 17 actuates the brake pad. The brake pad 18 is constructed to be in contact with periphery of the guide rail 6 at the block 5. The hydraulic cylinder 17 and brake pads 18 are made in couple.

When rotation of pinion 11 is delivered to the hydraulic pump 15 through the clutch 12 and the transmission gear 13. In the present invention, hydraulic pressure is generated from the hydraulic pump 15 to actuate the brake pad 18 by the hydraulic cylinder 17. Accordingly, the brake pad 18 in contact with the guide rail 6 causes brake by friction and as a result the elevator car 1 is stopped gradually.

Figure 6:
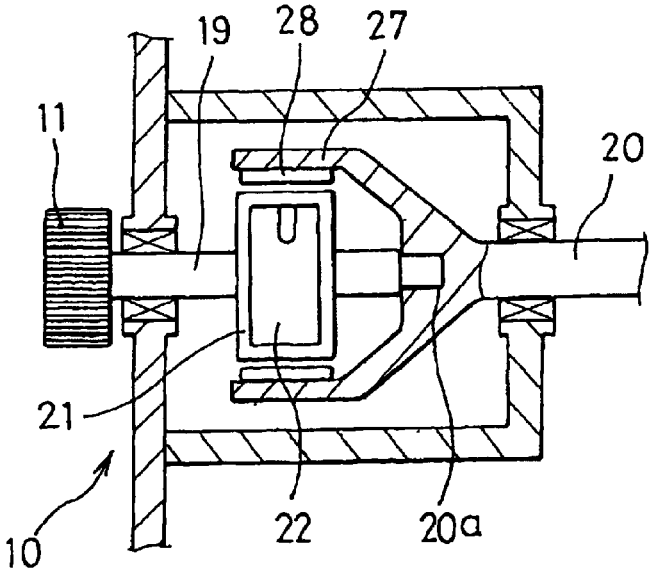
FIG. 6 is a sectional view of the clutch of the brake device according to the present invention.
Figure 7A:
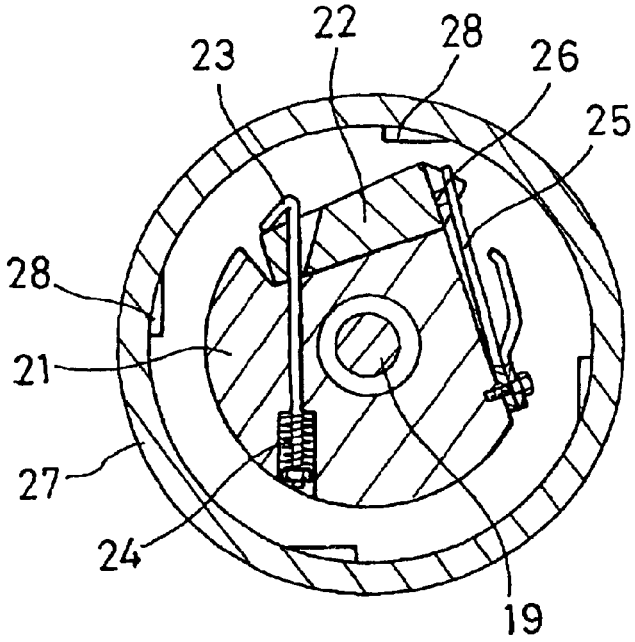
FIGS. 7*a* and 7*b* are sectional views of the clutch of the brake device according to the present invention.
Figure 7B:
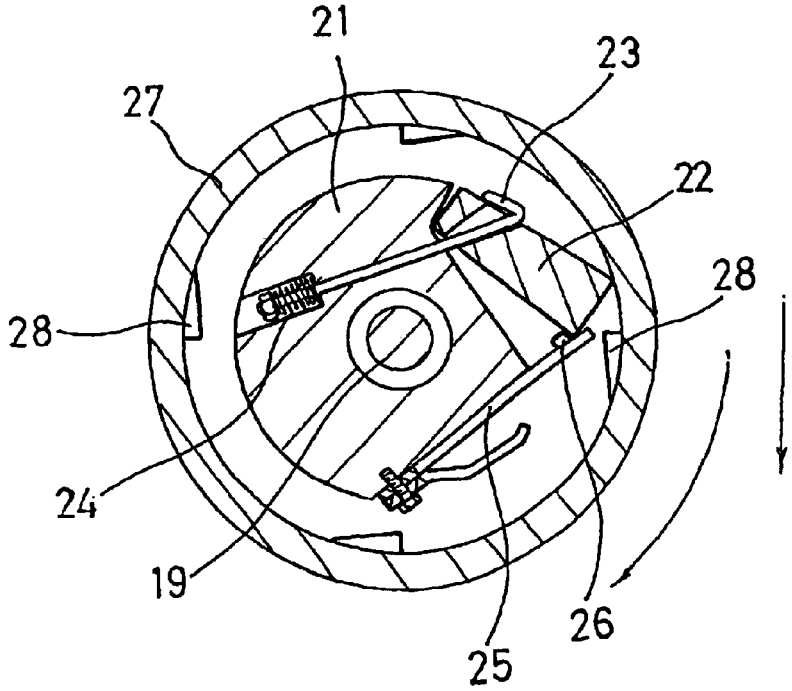

FIG. 6 is a sectional view of the clutch of the brake device according to the present invention; and FIGS. 7*a* to 7*b* are sectional views of the clutch of the brake device according to the present invention.

The clutch 12 is held in the hydraulic brake means 10 and includes a driving shaft 19 connected to the pinion 11, and a driven shaft 20 on the same axle with the driving shaft 19. The driven shaft 20 employs a bearing 20*a* for supporting front end of the driving shaft 19, and a clutch ring 27 at the outer periphery of the bearing 20*a*. In the inner periphery of the clutch ring 27, a plurality of bosses 28 is radial disposed. At the driving shaft 19, a balance weight 21 is disposed at the inner periphery of the clutch ring 27.

In the balance weight 21, a weight 22 restrained by adjusting spring 24 and adjusting lever 23 is suspended until the centrifugal force reaches a predetermined value. The balance weight 21 also employs a plate spring 25 and a stopper 26 for fixing the position of weight 22. If the weight 22 is deviated from the balance weight 21 by centrifugal force, the weight 22 is held at the stopper 26 of the plate spring 25 and cannot return to the original position.

In the constitution of the present invention, only the driving shaft 19 and the pinion 11 of the clutch 12 are rotated during normal lifting operation of the elevator car 1. In the normal lifting operation of the elevator, although the pinion 11 is rotated along the rack 4 and the rotational force is delivered to the driving shaft 19, the weight 22 at the outer periphery of the driving shaft 19 is not deviated but remains restraint by adjusting lever 23 because the centrifugal force due to the rotation is not heavy. The weight 22 maintains the original position with the balance weight 21 and rotates with the driving shaft 19 while the driven shaft 20 keeps suspended.

Accordingly, the present invention actuates the brake device in case of free fall of the elevator due to abnormality or malfunction, for example if the pinion 2*a* and the governor 3 for lifting the elevator upwards and downwards are damaged.

In case of free fall of the elevator, rotational number of the pinion 11 of a hydraulic brake device is more and more increased by acceleration. Over a predetermined increase of rotations of the pinion 11 causes a heavy centrifugal force on the weight 22 to exceed a limit over support force of the adjusting lever 23, thereby deviating from the balance weight 21.

FIG. 7*b* shows a deviated state of the weight 22. The stopper 26 of the plats springs 25 roles to support the weight 22 and the weight 22 cannot return to the original position. The weight 22 as deviated is held at any of boss 28 of the clutch ring 27, to integrally rotate the driving shaft 19 and driven shaft 20.

When the rotational force of the driving shaft 19 is delivered to the driven shaft 20, as shown in FIG. 5, the hydraulic pump 15 generates hydraulic pressure though the transmission gear 13 and cam 14. The hydraulic pressure is delivered to each hydraulic cylinder 17 over the hydraulic line 16 to actuate the brake pad 18 of the corresponding hydraulic cylinder 17 to cause friction on the guide rail 6 of the block 5.

During friction, the elevator car 1 performs stopping operation with less speed and is finally stopped.

Braking distance may be calculated by function of frictional coefficient, between the brake pad 18 and the guide rail 4, hydraulic power from the hydraulic cylinder 17, elevator weight, and falling speed of the elevator. The frictional coefficient, hydraulic power of the hydraulic cylinder 17 and falling speed of the elevator can be adjusted. The falling speed of the elevator can be controlled by escape speed of the clutch.

Figure 8:
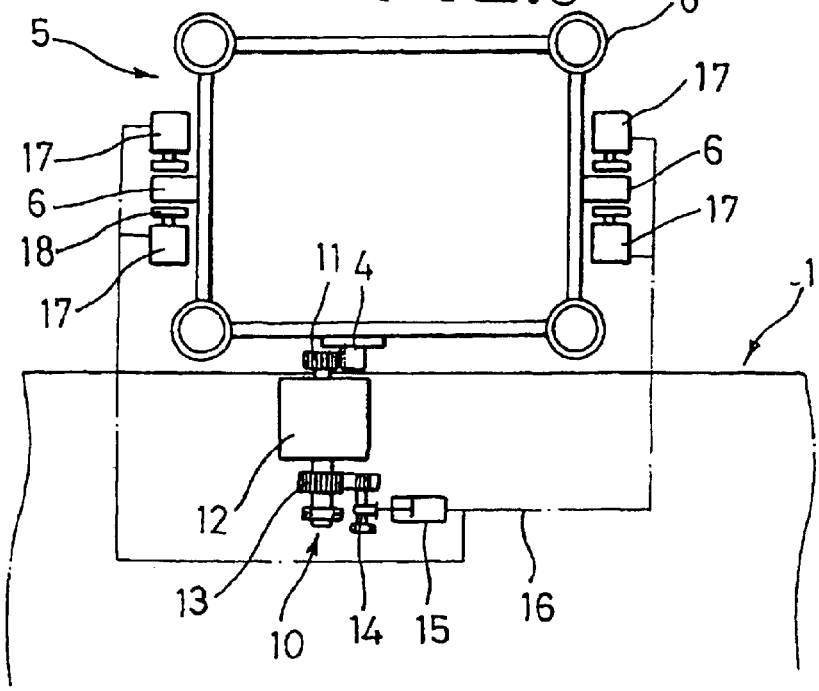
FIG. 8 is a plane view of another embodiment of the brake device of the present invention.

FIG. 8 is a plane view of another embodiment of the brake device of the present invention in which the contact position of the brake pad 18 with the guide rail 6 can be modified.

The guide rails 6 are formed at the center of block 5, in opposite. A pair of the hydraulic cylinders 17 and a pair of the brake pads 18 are formed with respect to the guide rails 6. The cross-sectional of the brake pads 18 and guide rails 6 may be circular, rectangular, lozenge-shaped or any other shape.

Figure 9:
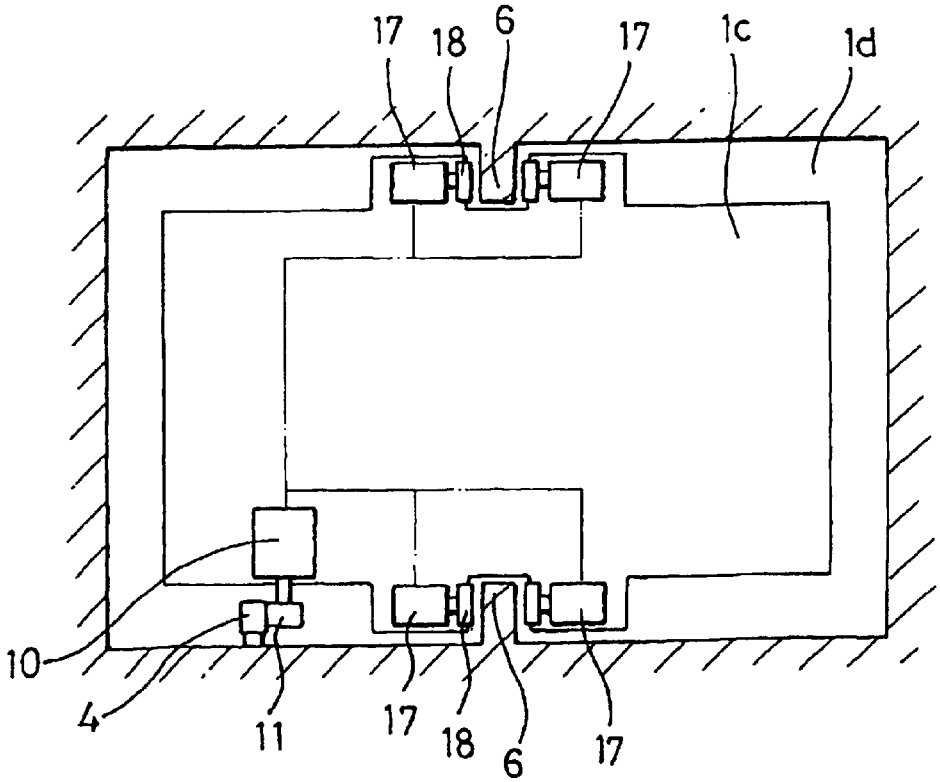
FIG. 9 is a plane view of the building elevator of brake device of the present invention.

FIG. 9 is a plane view of the building elevator of brake device of the present invention.

The hydraulic brake device 10 is disposed in the cage 1*c* and the pinion 11 of the hydraulic brake device 10 is tooth-engaged with the rack 4 formed at a lifting path 1*d*. At opposite sides of the lifting path 1*d* the guide rails 6 are formed to have a pair of the brake pads 18 and a pair of the hydraulic cylinders 17.

The same constitution of the brake device applies to the building elevator such that the pinion 11 is rotated at high speed and the weight connected to the pinions 11 becomes widened from the pinion 11 to connect the driving shaft with the driven shaft, thereby generating hydraulic pressure from the hydraulic pump via transmission gear and cam in case of free fall of the cage 1*c* of building elevator. The hydraulic cylinder 17 is actuated by hydraulic pressure and the brake pad 18 brakes the building elevator.

In the present invention, when fall of the elevator is detected, hydraulic pressure actuates the brake pad to brake the elevator, thereby protecting the passengers form sudden impact.

The brake device according to the present invention utilizes friction with less impact, so as to protect the passengers or luggage.

Further, the present invention does not utilize the pinion of governor tooth-engaged with the rack with more potential fatigue but utilizes the guide rail and brake pad with less fatigue, thereby preventing the accident due to damage of the rack and pinion. Accordingly, the present invention has an effect to improve product reliability and durability.

What is claimed is:

1. A brake device for elevator, comprising:

a hollow box-shaped elevator car;

block including a pair of guide rails for guiding upwards and downwards movement of the elevator car;

a plurality of racks disposed at the block along the lifting direction in vertical;

at least one motor having at least one pinion with toothed engagement at one of the racks, for causing upwards and downwards movement of the elevator car;

clutch for controlling power transmission to connect a driving shaft to a driven shaft when a corresponding pinion engages the corresponding rack and is rotated at high speed by elevator drop;

hydraulic pump for generating hydraulic pressure from power transmission through a plurality of transmission gears when the clutch delivers power; and a plurality of hydraulic cylinders for braking the elevator by moving a brake pad in tight coupled relationship with the guide rails by hydraulic power from the hydraulic pump.

2. A brake device for elevator as claimed in claim 1, wherein the driving shaft includes the corresponding pinion, the driven shaft supports the front end of the driving shaft, the driving shaft includes a balance weight having a weight, the driven shaft includes a clutch ring surrounding the balance weight, and at the inner periphery of the clutch ring the weight is held on a plurality of bosses, when the weight is deviated by centrifugal force and disposed for connecting the driving shaft and the driven shaft.

3. A brake device for elevator as claimed in claim 2, wherein an adjusting lever is disposed in the balance weight for hanging the weight, an adjusting spring is disposed at a rear end of the adjusting lever for controlling the centrifugal force of the weight, and a plate spring is disposed at one side of the balance weight with a stopper for preventing the weight from being returned to the original position.

* * * * *

UNITED STATES PATENT AND TRADEMARK OFFICE

CERTIFICATE OF CORRECTION

PATENT NO. : 6,830,132 B1
DATED : December 14, 2004
INVENTOR(S) : Shin-joon Kang et al.

It is certified that error appears in the above-identified patent and that said Letters Patent is hereby corrected as shown below:

Title page,
Item [22], PCT Filed, should read -- December 27, 2000 --.
Insert Item -- [30] Foreign Application Priority Data
April 18, 2000 (KR), Korean Application No. 2000-20394 --.

Signed and Sealed this

Thirtieth Day of August, 2005

JON W. DUDAS
*Director of the United States Patent and Trademark Office*